United States Patent [19]

King

[11] 4,055,860

[45] Nov. 1, 1977

[54] SAFETY CAP WITH ENERGY ABSORBING SUSPENSION

[75] Inventor: John H. King, Lilburn, Ga.

[73] Assignee: Norton Company, Worcester, Mass.

[21] Appl. No.: 772,742

[22] Filed: Feb. 28, 1977

Related U.S. Application Data

[63] Continuation-in-part of Ser. No. 716,829, Aug. 23, 1976, abandoned.

[51] Int. Cl.[2] ..... A42B 3/02

[52] U.S. Cl. ..... 2/416

[58] Field of Search ..... 2/411, 414, 416, 418, 2/419, 420

[56] References Cited

U.S. PATENT DOCUMENTS

| | | | |
|---|---|---|---|
| 2,921,318 | 1/1960 | Voss et al. | 2/416 X |
| 2,946,063 | 7/1960 | Boyer | 2/418 |
| 3,026,523 | 3/1962 | Bowers et al. | 2/416 |
| 3,154,788 | 11/1964 | Simpson | 2/418 |
| 3,192,536 | 7/1965 | Benner | 2/418 |
| 3,237,201 | 3/1966 | Morgan | 2/414 |
| 3,422,459 | 1/1969 | Bowers | 2/416 |
| 3,555,560 | 1/1971 | Rascke | 2/416 |
| 3,909,846 | 10/1975 | Zahn | 2/416 |

*Primary Examiner*—Alfred R. Guest

*Attorney, Agent, or Firm*—Walter Fred

[57] ABSTRACT

A safety cap has an energy absorbing suspension including crown straps for supporting engagement with the crown of a wearer's head connected to elastically deformable, rupturable and controlled plastically deformable portions of connecting means attached to anchor means in the shell of the cap. The connecting means have end portions adapted to be attached to and wedgingly engage the anchor means. The shock or impact of a blow against the shell suspended on the resisting wearer's head is partially absorbed initially by a wedging action which continues until the end portions are fully seated relative to the anchor means. Further, loading causes the crown straps to pull against, deform and bend energy absorbing portions of the connecting means into adjoining apertures of predetermined size and shape. Finally, at a predetermined force, the bending moments at opposite ends of the energy absorbing portions exceed the tensile yield strength of the material and causes the portions to rupture. The failure and plastic deformation thereof is thereafter controlled and limited by allowing them to progressively or successively bottom against control means about the apertures. An adjustable and removable headband including a sweatband is attached to and supported by the connecting means.

19 Claims, 17 Drawing Figures

SAFETY CAP WITH ENERGY ABSORBING SUSPENSION

RELATED APPLICATIONS

This application is a continuation-in-part of abandoned application Ser. No. 716,829 filed Aug. 23, 1976 now abandoned.

BACKGROUND OF THE INVENTION

1. Field of the Invention

The invention relates to safety head gear, safety caps, hard hats and the like and particularly to an energy absorbing suspension therefor.

2. Description of the Prior Art

Regulations of the federal agency OSHA require that safety caps must meet certain specifications directed to protect the wearer's head from being struck and injured by objects and to lessen the impact thereof transmitted to the wearer's head.

In a number of prior art safety caps the suspension includes a crown piece, crown straps and anchor lugs, which are as disclosed in U.S. Pat. Nos. 3,422,459, 3,909,846 and 2,946,063 molded in one piece from plastic material. During impact the shell resists the force of the falling object by being deformed and displaced closer to the crown of the head. During displacement only the strap portions of the unitized plastic suspension begin to yield, stretch or elongate and thereby absorb some of the shock of impact.

In other safety caps disclosed in U.S. Pat. Nos. 3,192,536 and 3,237,201 the suspension is an assembly of individual flexible parts. One or more of the flexible parts are or have portions of different length which are either elastically deformed, stretched or elongated in a sequence determined by its length to absorb a portion of the shock. In each case the shortest portion is stretched or elongated first to absorb part of the shock followed by the next longest and so on to absorb additional shock.

Applicant's safety cap differs from those of the prior art in that the suspension includes crown straps connected to first elastically yieldable, then rupturable and thereafter controlled plastically deformed and finally arrested energy absorbing portions of detachable connecting means. The connecting means have head portions attached to anchor means in the shell. A portion of an impact or shock is first absorbed by a wedging action which continues until the heads are fully seated against the anchor means.

Further amounts of the impact energy are absorbed by elastically deforming, bending and stretching the energy absorbing portions into adjoining apertures followed by partial rupture of and controlling the failure and plastic deformation by progressively or successively bottoming the plastically deforming energy absorbing portions against adjoining control means of predetermined size and shape.

SUMMARY OF THE INVENTION

A safety cap has a generally hemispherical hollow shell with a plurality of sockets angularly spaced around the lower portion of the shell wall adjacent the rim of the shell. Each socket has a cavity and a surface between a pair of narrower side surfaces extending from a retaining lip at the entrance to the socket cavity toward a stop land or surface at the upper part of the socket. A slot of predetermined width extends upwardly between spaced inner retaining wall portions of the socket.

Within and attached to the shell is a detachable energy absorbing suspension including connecting means, flexible crown straps, an adjustable and detachable headband and removable sweatband for supporting and maintaining the shell spaced from the wearer's head.

Each connecting means has an end portion inserted into, snapped by, and retained in a socket by the retaining lip. An intermediate portion of each connecting tab extends upwardly from the end portion in the socket and through the slot toward the interior of the shell. Connecting means are also connected to and support the headband and sweatband.

The crown straps have end portions which pass through slots and loop around deformable, and then rupturable shock absorbing portions in the intermediate portions of each pair of connecting means anchored to the shell.

Thus, the force resulting from an object striking the shell is uniformly distributed and attenuated by first wedging of the connecting means in the sockets followed, if necessary, by elastically deforming, bending, elongating beyond the elastic limit, rupturing and thereafter controlling the plastic deformation of the energy absorbing portions of the connecting means anchored to the shell.

Therefore, it is the primary object of the invention to provide a safety cap with an improved energy absorbing suspension, that attenuates the force of impact transmitted to the person's head.

DESCRIPTION OF THE PREFERRED EMBODIMENT(S)

Figure 1:
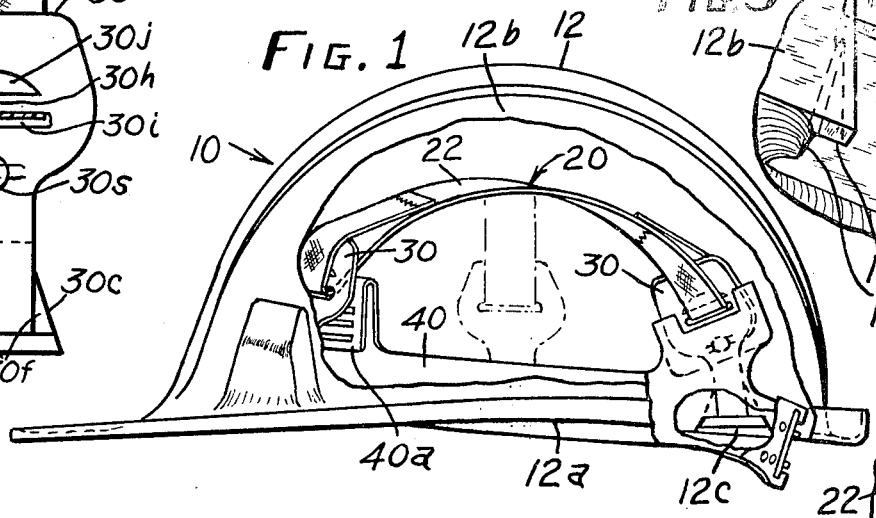
FIG. 1 is a side view in elevation of the safety cap, with a portion of the hollow shell cutaway to show portions of the energy absorbing suspension within the shell.
Figure 3:
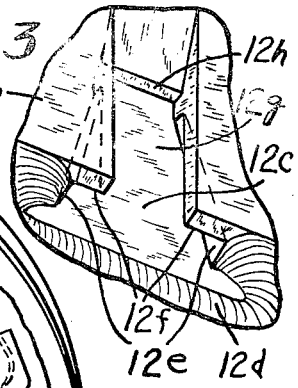
FIG. 3 is a perspective view of one of the sockets in the shell for attaching the suspension to the shell.
Figure 5:
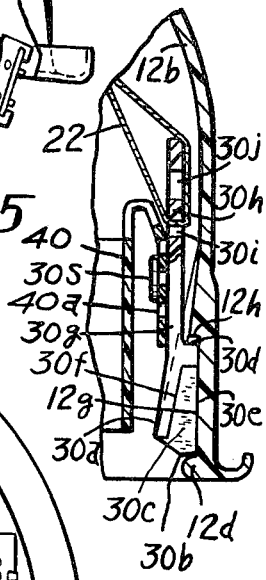
FIG. 5 is a vertical sectional view through one of the sockets in the shell and the attached connecting means including the fastening means shown in FIG. 4 attached to and supporting a headband.
Figure 2:
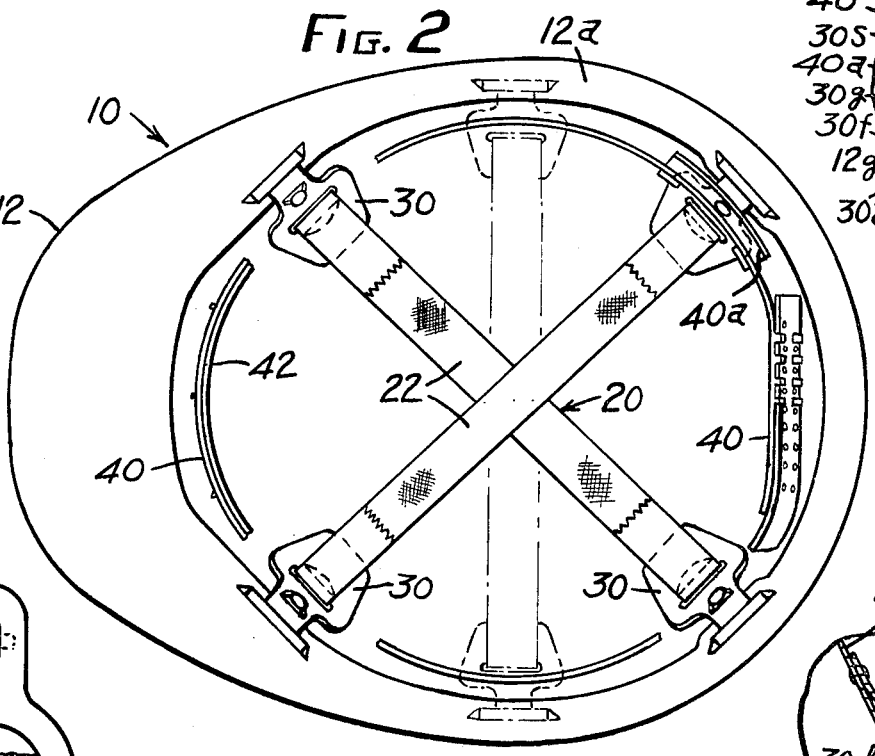
FIG. 2 is a bottom view of the safety cap of FIG. 1 showing the arrangement of the individual parts of the energy absorbing suspension attachment to the shell.
Figure 8:
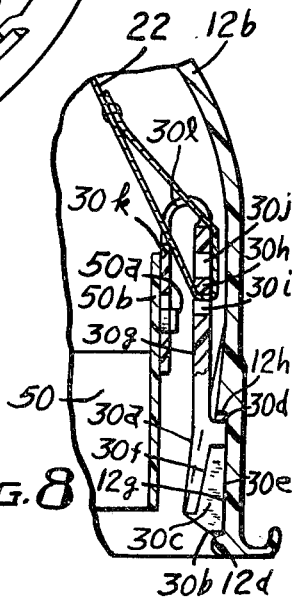
FIG. 8 is a vertical sectional view through one of the sockets in the shell and the attached connecting means shown in FIG. 7 with its opposite end portion bent downwardly and connected to the headband and its intermediate energy absorbing portion connected to the crown strap.

One embodiment, of many possible embodiments, of a safety cap constructed in accordance with the invention is shown by example in FIGS. 1 and 2. The safety cap 10 comprises preferably an integrally molded hollow polyethylene shell 12 which may be made in any suitable manner and of plastic, metal, reinforced plastics and dielectric plastic materials. The shell 12 has a lower edge brim or rim 12*a* which may or may not be in the form of a rain gutter shown and extending upwardly therefrom a generally hemispherical or convex shaped wall portion 12*b*, including an internal concave cavity for receiving and protecting the wearer's head. Angularly spaced around, extending outwardly from the portion 12*b* and upwardly from the rim 12*a* of the shell are a number or pairs of wedge shaped sockets or anchor means 12*c* for attaching a suspension to the shell. As shown in FIGS. 3, 5 and 8 each socket has about its entrance an inwardly extending connecting tab retaining lip, protuberance or portion 12*d* of the rim. Extending upwardly from the entrance are a spaced pair of opposing inner narrow, tapered and inclined end wall surfaces 12*e*, an inner slotted sidewall surface 12*f* interrupted by the slot and a relatively larger outer sidewall surface 12*g* extending between the tapered and inclined end wall surfaces 12*e*. At least one of the opposing sidewalls 12*f* and 12*g* is inclined relative to the other and thereby provide a tapered or wedge shape cavity between them. Preferably, the inner slotted sidewall surface 12*f* is inclined at an angle of at least 3° and no more than 20° from the outer sidewall surface 12*g*, and the tapered inclined end wall surfaces 12*e* are inclined, relative to each other at an angle of between 10° and 50°.

The wedge shape socket, pocket or cavity has generally a rectangular cross sectional configuration which in the particular embodiment shown tapers in two planes situated at right angles to each other and decreases in size from the larger entrance about 0.9375 inches (23.7 mm) by 0.190 inches (4.83 mm) toward a socket land or stop surface 12*h* about 0.5 inches (12.7 mm) by 0.070 inches (1.78 mm) at the upper opposite end of the cavity.

The slot in the inner sloted sidewall 12*f* is situated substantially in the center of the wedge shaped socket, is substantially as wide as the socket land 12*h* and extends from the entrance to an opposite end intersecting the interior surface of the shell beyond the socket land.

The anchor means or sockets 12*c* are preferably arranged in pairs and situated directly opposite one another in the shell. There being at least two pairs or four sockets angularly spaced around the hemispherical wall portion 12*b* of the shell 12. One of each pair of cooperating sockets is preferably located in a rear portion and the other in a front portion of the shell located on opposite sides of the shell and a plane passing through the center of the hemispherical portion of the shell 12.

A detachable energy absorbing suspension or harness 20 is provided for contacting the wearer's head and suspending the shell 12 a predetermined distance away from and above the crown of the wearer's head. The suspension of harness 20 comprises at least one pair of flexible crossing crown straps 22 each of which extends between and have opposite end portions connected to a pair of connecting means, tabs or links 30 anchored to the shell sockets or anchor means 12*c*. The cross straps 22 are preferably made of a high tensile strength flexible material such as woven nylon or an equivalent material which may stretch for example approximately 25% with a tensile load of 200 lbs. (90.718 kg).

If desired and as shown in phantom lines in FIGS. 1 and 2 additional cooperating sockets connecting means and crown straps may be provided and situated substantially in planes passing between the others and through the center of the hemispherical portion 12*b* of the shell 12 to provide a safety cap with more than a four point suspension system.

Referring to FIGS. 4 to 8, each of the connecting means, tabs or links 30 have a substantially rigid lower wedge shape portion or head 30*a* which corresponds to substantially the size and shape of the sockets and mates with inclined surfaces in the wedge shape sockets 12*c*. The wedge shape portion 30*a* has a lower or bottom beveled surface 30*b* from which a pair of inclined and tapered side edge surfaces 30c extend upwardly toward one another to a top surface or shoulder 30d initially spaced a slight distance from the socket land or stop surface 12h.

The wedge shape portion 30a also has a rear surface 30e which mates with the outer sidewall surface 12g in the socket, and spaced right triangle shape front tapered surfaces 30f which mate and engage the similarly spaced right triangle shaped portions of the slotted inner sidewall surface 12f in the socket 12c.

At the bottom beveled surface, the wedge shape portion 30a is substantially as wide as the entrance of the socket cavity so that it will have a snug fit in the wedge shape socket, can be snapped by and retained in place by the retaining lip 12d as shown in FIG. 5. The height or length of the wedge shape portion 30a between the bottom beveled surface 30b and top shoulder or surface 30d is preferably less than the height of the socket to provide a limited amount of shock absorbing wedging movement between the wedge shape portion 30a and the socket 12c.

Between the spaced right triangle shape front tapered surfaces 30f, the wedge portion has an integral narrow strip like portion which extends into and through the slot in the inner slotted sidewall 12f to a similar narrow flexible part of an intermediate portion 30g.

In the intermediate portion 30g of the connecting means 30, is an elastically and plastically deformable energy absorbing portion, strip or beam like portion 30h having a straight lower edge adjoining a narrow slot 30i through which an end portion of the crown strap 22 extends. Control means are provided for allowing elastic deformation and then progressively controlling and limiting plastic deformation of the energy absorbing portion.

Figure 6:
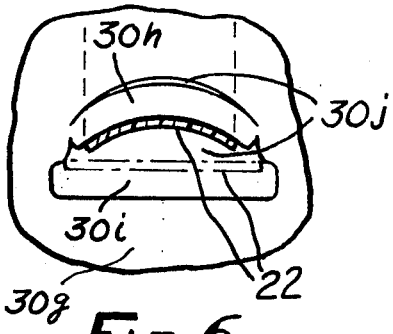
FIG. 6 is an enlarged partial view in elevation showing the energy absorbing portion connected to the crown strap elastically deformed, bent, elongated, ruptured and plastically deformed in a controlled manner during the process of absorbing energy.

Preferably, the control means adjoining the upper straight edge of the beam 30h comprises an arcuate or partly moon shape aperture 30j and arcuate edge into which the beam may be displaced, bent into an arc, ruptured and pulled progressively against the concave or arcuate edge of the arcuate slot as shown in FIG. 6 in the process of absorbing energy applied to it by way of the crown strap 22.

The amount of plastic deformation of the beam is determined and limited by the initial maximum center distance and space between the arcuate edge and the beam. Preferably, the center point of the concave edge is situated to obtain maximum deformation of and yet prevent the beam from breaking apart and/or its ends separating from the connecting means.

Means are provided on the connecting means for attaching and supporting an adjustable and detachable headband 40 including a replaceable sweatband 42. In one embodiment of the connecting means shown in FIGS. 4 and 5 the attaching means comprises a headed fastener, stud or button 30s attached to and extending from the intermediate portion 30g. The enlarged head of the fastener 30s extends through one of a number of vertically spaced and relatively smaller expandable slots or apertures in a downwardly extending flexible connector or tab portion 40a of the headband 40 retained in a groove between the enlarged head and the intermediate portion 30g.

Figure 7:
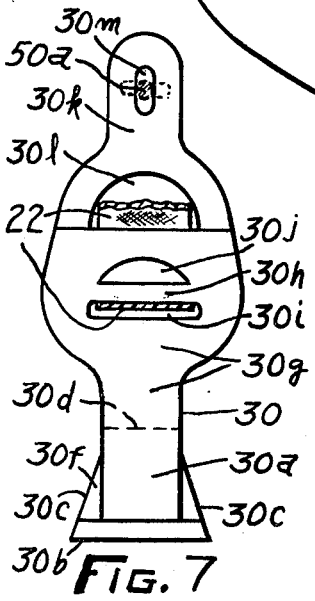
FIG. 7 is a front view in elevation of a modification of the connecting means shown in FIG. 4 having alternative fastening means including an opposite end portion adapted to be folded downwardly for attaching and supporting a headband.

In an alternative embodiment of connecting means shown in FIGS. 7 and 8 the attaching means comprises an integral extension or a relatively thinner and more flexible opposite end or tail portion 30k with an aperture 301 therein adjoining the intermediate portion 30g. The lower or straight side of the aperture is situated at the junction with the intermediate portion and a fold line along which the opposite end or tail portion 30k is bent downwardly, as shown in FIG. 8, to support an adjustable headband 50 and sweatband, attached thereto. The opposite end portion 30k has a narrow slot 30m into which an integral T-shape fastener 50a in each of a plurality of upwardly extending integral tabs or connector portions 50b of the adjustable headband 50 are inserted and turned to support and lock the headband 50 and sweatband to the connecting tabs 30.

Referring to FIGS. 5 and 8 it can be seen that the end portion of each of the crown straps 22 either pass through the aperture 301 and then the slot 30i, or directly through the slot 30i, loop around the beam 30h and the upper end of the intermediate portion 30g and then fastened together in any suitable manner. Preferably, they are sewn together by a bar tack stitch, making the crown strap of predetermined fixed and nonadjustable length to maintain and suspend the shell structure a predetermined distance from the crown of the wearer's head.

The shock absorbing connecting tab or means 30 may be made of a number of suitable materials but is preferably molded of a ductile plastic material such as polyethylene or its equivalent having a modulus of elasticity of 150,000 p.s.i. (10545 kg/cm$^2$) and tensile strength of 3500 p.s.i. (246.05 kg/cm$^2$) at 75° F (23.88° C).

In a preferred embodiment of the invention, each of the connecting means 30 have an intermediate portion 30g with a substantially uniform thickness of about 0.100 inch (2.54 mm) and an equally thick beam like energy absorbing portion 30h about 0.150 inches (3.81 mm) wide by 0.630 inches (16 mm) long at its top or opposite edge and bottom of the arcuate aperture 30j. The upper concave or arcuate edge of the aperture has a radius of approximately 0.375 inches (9.527 mm) extending to a maximum center height of 0.170 inches (4.32 mm) from the top edge of the beam 30h. The slot 30i and opening 301 were about 0.750 inches (19.05 mm) in width to accept crown straps about 0.6875 inches (17.4605 mm) wide. The maximum width of the tab 30 was about 1.46 inches (37.0 mm) measured substantially in a plane passing longitudinally through the slot 30i. The length of the lower straight edge of the beam was substantially equal to the width of the crown straps 22 and hence longer than its opposite upper straight edge adjoining the arcuate aperture 30j.

The wedge shape portion 30a and thickest part of connector tab 30 had an upper shoulder about 0.110 inches (2.794 mm) deep by 0.495 inches (12.57 mm) wide and spaced right triangle shape front tapered surfaces 30f inclined at an angle of 11° from the adjacent vertical side of the intermediate portion 30g. The tapered end surfaces 30c were inclined toward each other at an angle of about 20° and the height of the wedge portion 30a was about 0.775 inches (19.685 mm) from the bottom 30b about 0.9375 inches (23.7 mm) wide to the shoulder 30d which was initially spaced about 0.0625 inches (1.5875 mm) from the stop or socket land 12h.

When a safety cap of the invention is struck by an object the shock of energy of the impact is absorbed by various cooperating elements of the safety cap. The shock absorbing elements operate in a predetermined sequence to decelerate the velocity of the object, in a given amount of displacement of the shell, to thereby lessen the force of the impact transmitted to the wearer's head.

Following the first instant of impact, the shell suspended on the crown of the resisting wearer's head is forced downwardly and displaced relative thereto. During the downward movement or displacment the crown straps 22 between the connecting tabs are initially placed in tension which in turn pull against, and bows the intermediate portions 30*g* and tensions the connecting means 30 anchored in the wedge shape sockets of the shell.

A further application of the force of the impact causes the shell to move closer to the head whereupon the wedge shape end portions 30*a* of the connecting tabs 30 are forced upwardly and wedged further and tightly in the wedge shape sockets until they bottom against the socket lands 12*h*. Thus at this point, a certain amount of the energy of the impactor is absorbed and utilized during the tensioning and wedging action between the cooperating members to reduce the velocity and hence the force transmitted to the wearer's head.

After the wedge shape portions have bottomed out any additional force of the impact is transmitted by each of the further stressed or tensioned crown straps to the shock absorbing beam like portions 30*h* of the intermediate portions of the connecting means 30.

Figure 4:
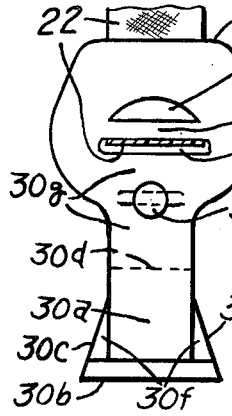
FIG. 4 is a front view in elevation of one of the unique connecting means of the suspension having an end portion insertable into the sockets for attachment to the shell, an intermediate energy absorbing portion attached to an end of a crown strap and headband fastening means projecting from a side thereof.

As the additional force is applied each of the beams 30*h* begin to bend at the center from the straight position shown in FIG. 4 upwardly into the arcuate shape aperture, toward and into abutting engagement with the concave edge surface of the aperture 30*j* as shown in FIG. 6.

During the bending process the beam is also being elongated and elastically drformed until stressed beyond the elastic limit or yield point of the material.

Finally, when a predetermined force of the impact is reached the bending moment at opposite ends of the beam exceed the tensile yield strength or elastic limit of the material. The elastic limit being determined by the elastic modulus of the material, the thickness, height and maximum width or length of the beam measured at the bottom or lower edge of the beam adjoining the slot 30*i*, and difference in the horizontal distance between the ends of the straight opposite upper and lower straight edges of the beam. Exceeding the elastic limit causes the material to rupture and split at the opposite lower edge ends of the beam as shown in FIG. 6.

When the material ruptures and splits it creates a stress raiser that causes further plastic deformation or flow due to shearing at the ends of the beam. However, failure and plastic deformation of the beam 30*h* is controlled and limited by the arcuate edge of the arcuate or half moon shape aperture 30*j*. Since the upper straight edge of the beam adjoining the arcuate aperture 30*j* is shorter than the lower straight edge of the beam adjoining the slot 30*i* the beam does not split completely away from the remainder of the connecting tab. It begins to split at substantially the tangent point of its lower straight edge with the adjacent downwardly extending curved or concave edges at the opposite ends of the slot 30*i*.

As it ruptures the beams continue to be deformed and bent because progressively more and more of the opposite end portions of the beams are pulled into abutting engagement with the adjacent end portions of the concave edge of the aperture 30*j*. Controlled plastic deformation and bending of the beam continues until the entire upper edge and center of the beam is in engagement with the entire concave edge of the aperture 30*j*.

Thus the concept of the invention is that the ductile plastic material once forced beyond elastic deformation into plastic deformation controlled and limited as taught hereinabove is used to absorb energy and substantially attenuate impact forces in a safety cap.

An impact or energy absorbing test was conducted on a safety cap of the invention with four or two pairs of sockets therein and equipped with a four point suspension 20. The four point suspension 20 was comprised of two crossing crown straps 22 connected to two cooperating pairs of connecting tabs 30 of the size and shape disclosed hereinabove.

The safety cap was placed on the inanimate head of a dummy or model imitating the average size and shape of a human head. At the point of impaction and center of the hemispherical portion of the shell, the cap was suspended approximately 1.375 inches (35 mm) above the crown of the inanimate head of the model attached to a force measuring device.

A spherical shaped object weighing about 8 lbs. (3.629 kg) was dropped from a height of 5 feet (1.524 m) directly in the center of the hemispherical portion of the shell. During impact the peak force was measured to be approximately 700 lbs. at 0° F (317.8 kg at −18° C), 450 lbs. at 120° F (204.3 kg at 48.8° C) and the beams 30*h* in each of the connecting tabs were nearly completely bottomed against the concave edge of the arcuate aperture 30*j*. The results of the test showed that the safety cap of the invention reduced the force transmitted to the wearer by approximately 50 lbs. (22.68 kg) to 100 lbs. (45.36 kg) less than a substantially identical safety cap in which the connecting means differed only in that they did not have the specific energy absorbing features taught by the invention. Instead the connecting means were adapted to be initially fully seated in the sockets and have a pair of spaced identical narrow slots through which the crown straps were threaded and looped around a relatively large and more rigid portion measuring about 0.500 inches (12.7 mm) between the slots.

Figure 9:
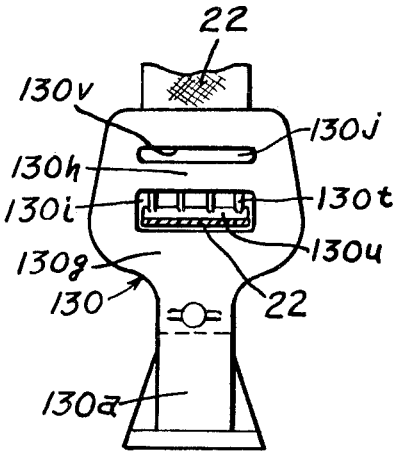
FIG. 9 is a front view in elevation of another form of connecting means having an intermediate energy absorbing portion including a relatively smaller secondary energy absorbing beam engaged by a crown strap and attached to a primary energy absorbing beam by spaced integral depending connecting parts.
Figure 10:
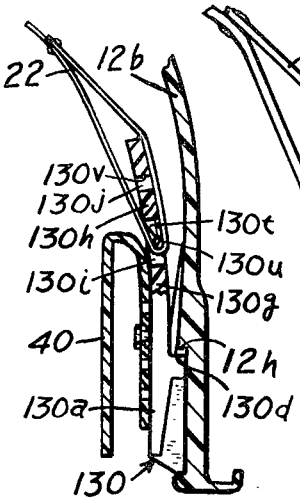
FIG. 10 is a vertical sectional view through one of the sockets in the shell and the attached connecting means including the fastening means shown in FIG. 9 flexed slightly inwardly of the shell, attached to and supporting a headband.
Figure 15:
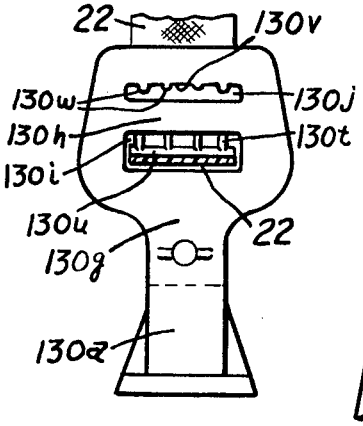
FIG. 15 is a front view of still another form of connecting means similar to that shown in FIG. 9 with the exception that it has as shown control means including spaced downwardly extending projections which contact and limit the displacement of the opposite end portions of the primary energy absorbing beam.

Further embodiments of energy absorbing connecting means falling within the teachings of the invention and which may be attached to the shell 12 as disclosed above are shown in FIGS. 9, 10 and 15.

With the exception of the energy absorbing portions and the adjoining control means the connecting means 130 shown in FIGS. 9, 10 and 15 are substantially identical in size, shape and material as the connecting means 30 described above and shown in FIGS. 4 and 5. Thus, only the construction and operation of the intermediate energy absorbing portions and control means of the connecting means will be described hereinbelow.

Referring to FIGS. 9, 10 and 15 the connecting means 130 are substantially identical to one another and have a lower wedge shape portion 130*a*, adapted to fit and wedge into the sockets 12*c* in the shell 12. In the adjacent intermediate portion are elastically and plastically deformable compound energy absorbing means comprising a primary energy absorbing portion strip or beam like portion 130*h* having a relatively straight lower edge adjoining an opening 130*i* about 0.782 inch (19.87 mm) long by 0.282 inches (7.2 mm) in width or height and an upper edge adjoining control means including a relatively narrower elongated aperture or slot 130*j*. Depending from the lower edge of the primary energy absorbing beam and into the opening 130*i* are support means comprising a plurality of integral relatively thin or narrow projections, legs, connectors or gussets 130*t* about 0.093 inch (2.4 mm) long, the opposite ends of which are integrally connected to and support a secondary or auxiliary energy absorbing portion strip or beam like portion 130*u* engageable by a crown strap 22. The opposite ends of the secondary beam being spaced from and disconnected from the sides of the intermediate portion. Preferably, the secondary beam is about 0.062 inches (1.6 mm) in height or width and thickness and about 0.750 inches (19 mm) in length and of less cross sectional area than the primary beam.

As shown in FIGS. 9, 10, and 15 the elongated secondary energy absorbing strip or beam 130*u* of substantially rectangular cross sectional shape is relatively shorter, narrower in height or width and thinner than the primary beam 130*h* substantially parallel thereto and is situated off center, preferably either closer or flush with one side or the outside of the intermediate portion nearest the shell 12. Preferably, each of the gussets or connectors 130*t* have an outer side flush or aligned with the outside of the intermediate portion and an inner or opposite beveled side which tapers inwardly and upwardly from the top of the secondary beam to the underside or lower side of the primary beam. The gussets, spaced longitudinally between the primary and secondary beams may be of the same or different thickness but preferably there are a spaced pair of thin gussets about 0.062 inch (1.6 mm) thick situated between a spaced pair of relatively thicker gussets about 0.078 inch (1.98 mm) thick and of greater cross sectional area located adjacent and nearer the ends of the primary and secondary beams. Alternatively, the spaces between the gussets 130*t* may be closed off by a very thin or flash layer of the molded material of which the connecting means is made. Thus instead of passages or openings, there would be recesses extending between the gussets from the inside beveled edge to an additional thin layer situated flush with the outside of the intermediate portion.

Adjoining the secondary beam is a narrow portion of the slot or opening 130*i* through which the end portion of a crown strap 22 passes and loops around the secondary beam, primary beam and an adjoining upper poriton of the connecting means 130.

The control means adjoining the primary energy absorbing portion or beam 130*h* in each of the connecting means 130 shown in FIGS. 9 and 15 differ slightly from one another and the control means in the connecting means 30 shown in FIGS. 4, 6 and 7.

Referring to FIGS. 9 and 15 each of the control means includes the narrow elongated aperture or slot 130*j* of about 0.7825 inches (19.87 mm) in length by about 0.125 inches (31.75 mm) in width or height adjoining the upper edge of the primary beam 130*h* of substantially the same length as the elongated slot 130*j* and opening 130*i.* Adjoining the upper side or edge of each slot 130*j* is an upper end portion of the connecting means 130 which has a straight edge or surface 130*v* opposing and against which the primary energy absorbing beam can bottom to control and limit the deformation and displacement of the energy absorbing means.

Figure 16:
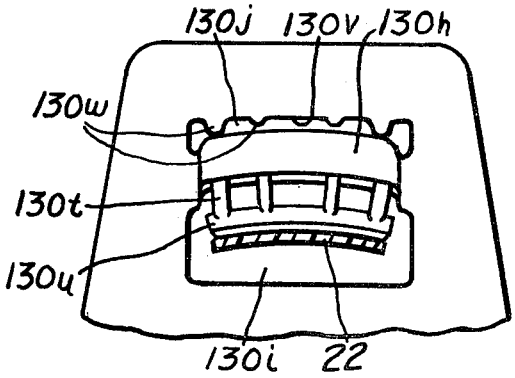
FIG. 16 is an enlarged partial front view of the upper portion of the connecting means shown in FIG. 15 after the primary and secondary energy absorbing beams have been partially deformed and displaced into engagement with the downwardly extending projections limiting the displacement of the opposite end portion of the primary beam.
Figure 17:
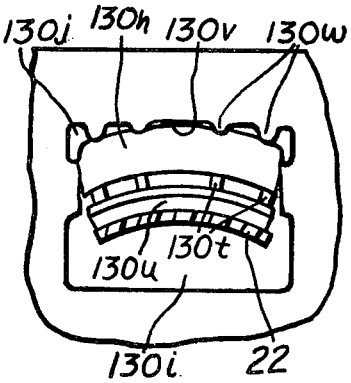
FIG. 17 is a partial front view of the upper portion of the connecting means and the secondary and primary energy absorbing beams shown in FIG. 16 fully deformed, displaced against and limited by the projections and the center of the control means.

The control means shown in FIGS. 15–17 has additional means in the form of spaced pairs of inner short and relatively longer outer posts or protrusions 130*w* which depend, substantially in alignment with the equally spaced gussets 130*t,* from the opposite ends of the lower straight edge on the upper portion of the connecting means. Each of the longer protrusions 130*w* projects downwardly into the slot 130*j* and toward the primary beam a predetermined distance of up to $\frac{7}{8}$ the width of the slot for the purpose of controlling and limiting the displacement, rupture and shear of each opposite end and the center portion of the primary beam. Preferably, the long posts 130*w* adjacent the opposite end portions of the beam project equal amounts of about 0.050 inches (1.27 mm) whereby a displacement gap of about 0.075 inches (1.9 mm) is left initially between each post and the opposing end portion of the primary beam and the spaced pair of shorter protrusions are about $\frac{1}{2}$ the length of the long protrusions.

Alternatively, the posts 130*w* may be a part of and extend upwardly from the primary beam toward the edge 130*v* whereby the primary beam and posts would be displaced together into engagement with the straight edge 130*v.* The straight edge 130*v* and the posts could be replaced by a concave edge extending arcuately between the ends of the protrusions, ending either at the ends of the long protrusions or the sides of the intermediate portion and have a depth or vertical height at the center equal to the width of the slot 130*j.* Also, the shorter pair of posts could be eliminated and extending the edge between the longer posts 130*w.*

In the process of absorbing the energy of an impact against the shell 12 the shell is forced downwardly or displaced relative to the head and the engaging crown straps 22 looped around the secondary beams of each pair of connecting means 130. The initial portion of the impact tensions the crown strap against the persons head, bows the intermediate portion of the connecting means after which the wedge shape portions 130*a* are forced wedgingly into full seating engagement with the shoulder in the sockets and thereby absorbing a part of the energy of impact.

Figure 11:
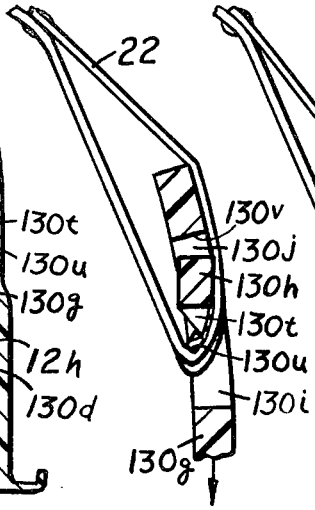
FIG. 11 is an enlarged vertical sectional view through the upper inwardly bent or flexed portion of the connecting means showing a partial displacement and deformation of the secondary and primary energy absorbing beams as a result of an impact displacing the shell downwardly.
Figure 13:
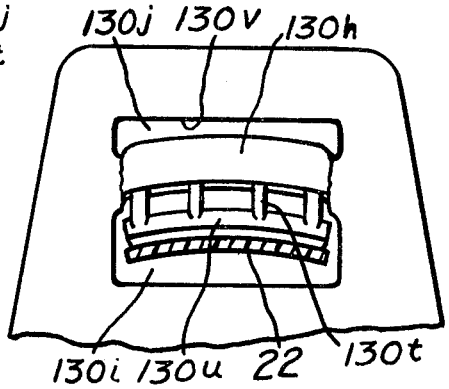
FIG. 13 is a partial front view of upper portions of the connecting means and the partially displaced and deformed secondary and primary energy absorbing beams shown in FIG. 11.

Once seated a further part of the impact energy is absorbed when the crown straps pull against, bend, twist and deform the secondary and primary energy absorbing beams 130*u* and 130*h.* As shown in FIGS. 11, 13 and 16 the downward movement of connecting means 130 anchored to the shell 12 causes the crown strap to bend the relatively weaker and smaller secondary beam 130*u* inwardly toward both the inner side of the connecting means 130 and the beveled or tapered edges of the gussets 130*t.* During bending the outside portions of the gussets 130*t* and if present the thin layer or flash are stretched. Since the inner gussets 130*t* are weaker and thinner, the applied force tends to bend the secondary beam arcuately more in the center than at its ends attached to the thicker gussets 130*t.* The force applied at the ends of secondary beam is transmitted by the more resistant thicker gussets 130*t* to the end portions of the stronger primary beam connected to side portions of the intermediate portion being forced downwardly by the impact.

The primary beam has greater resistance to shear at its ends than it has resistance to bending at the center. Therefore, an additional force of the impact applied through the secondary beam causes the primary beam to twist and bend slightly in the center until the elastic limit of the material at the ends of the primary beam is exceeded and begins to shear and flow plastically.

Figure 14:
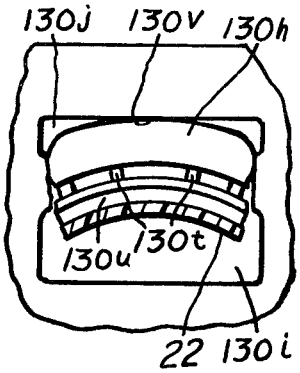
FIG. 14 is a partial front view of the upper portion of the connecting means and the secondary and primary energy absorbing beams shown in FIG. 12 further deformed, displaced and limited by engagement with the control means.

The application of an additional amount of the force of impact displaces the connecting means downwardly whereupon the center of the upper convex edge of the slightly arcuately bent primary beam is contacted by and bottoms against the straight surface or edge 130*v* of the control means as shown in FIG. 14.

Upon contact, further plastic deformation, shear or flow of the material at the end portions of the primary beam is limited and controlled by the progressive contact of greater amounts of the convex edge of the beam with the straight edge 130*v*. Thereafter, any additional force of an impact forces the upper portion of the connecting means downwardly and progressively straightens out the primary beam against the straight edge which allows a further controlled amount of plastic flow of the material at the ends of the primary beam. However, prior to the straightening of the primary beam a portion of the impact energy is absorbed by the further bending and pivoting of the secondary beam 130*u* into engagement with the tapered or beveled edges of the projections or gussets 130*t*.

Under an additional force of the impact the previously bent primary beam simultaneously begins to straighten out, become longer and its end portions progressively displaced further into the narrow elongated slot 130*j* and bottomed against the straight edge 130*v*. During the simultaneous lateral elongation and vertical displacement of the primary beam there are both compressive forces and shear forces being simultaneously applied to the material at the ends of the primary beam. The compressive force acts to push the material together and feed it into the path or stream of plastic flow caused by the shear forces. Hence, the primary beam is only partly ruptured and not separated completely from the adjoining side portions of the intermediate portion.

Figure 12:
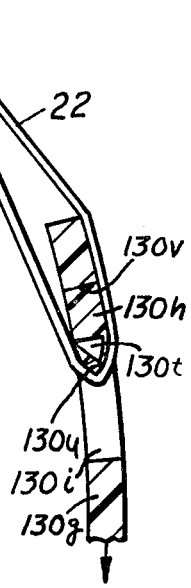
FIG. 12 is an enlarged vertical sectional view through the upper inwardly flexed portion of the connecting means showing a full displacement and deformation of the primary and secondary energy absorbing beams against one another and the adjacent control means as a result of an impact displacing the shell downwardly.

Up to the point of contact with the adjoining control means the energy absorbing means shown in FIGS. 15, 16 and 17 absorbs energy by deformation of substantially identical elements in substantially the same sequence and manner as does the energy absorbing means described above and shown in FIGS. 9, 13 and 14. The difference being, as shown in FIGS. 15–17, that the control means includes the spaced downwardly projecting posts or bars 130*w* which partially indent themselves into and limit the displacement of the end portions, of the slightly bend primary beam 130*h*. Thus, the major portion of plastic deformation of the material at the ends of the primary beam due to shear forces is limited and controlled by the engaging posts 130*w*. However, when an additional downward force is applied to the connecting means, the posts force the ends of the primary beam and the attached partially deformed secondary beam against the crown straps which acts to first pivot and bend the weaker secondary beam 130*u* against the gussets 130*t* and then bend the primary beam 130*h* until it bottoms against each of the posts and the straight edge 130*v* as shown in FIGS. 12 and 17. During bending of the primary beam into an arc the material adjacent the convex edge of the primary beam stretches or elongates while the material adjacent the concave edge is compressed or shortened producing a lateral pulling force which stretches and provides an additional amount of plastic flow of the material adjoining the ends of the primary beam. The plastic deformation of the energy absorbing means is controlled and limited by successively or sequentially displacing the primary beam into engagement with the posts 130*w* and then further bending it arcuately until the center of its convex edge bottoms against the edge 130*v*.

Obviously, the amount of deformation and displacement of the energy absorbing portions is determined by the severity of the impact and the temperature at the time of impact. That is, an impact of the same magnitude against the shell in a hot environment would displace the energy absorbing means a greater amount than when impacted in a colder environment. Therefore, the primary beam may be either fully or partially deformed and displaced relative to the control means and under a sufficient amount of impact the primary beam would obviously be fully deformed and displaced into limiting engagement with the control means.

Comparative impact energy absorbing tests of the type disclosed above were conducted on identical safety cap shells with two pairs of sockets therein attached to a four point suspension including two cooperating pairs of the connecting tabs 130 attached to substantially identical crown straps 22. The shell of the cap was likewise suspended about 1.375 inches (35 mm) above the crown of the inaminate head attached to the force measuring device and impacted at the center by the 8 lb. (3.629 kg) spherical object dropped from a height of 5 feet (1.524 m).

The peak force measured was approximately 626 lbs. at 0° F (284.3 kg at −18° C) and 464 lbs. at 120° F (210.6 kg at 49° C) and the primary beams 130*h* had not bottomed against the edge 130*v*. The results of the energy absorbing tests revealed that at the lower cold temperature of 0° F the connecting tabs 130 were slightly better than the connecting tabs 30 and reduced the force transmitted to the wearer by approximately 74 lbs. (33.56 kg). At the higher hot temperature of 120° F the connecting tabs 130 were about equal and only slightly less effective than the connecting tabs 30 by a difference of 14 lbs. (6.3 kg).

However, the energy absorbing safety caps of the present invention are shown to be more effective than those of the prior art in which the peak force is typically around 797 lbs. of 0° F (361.8 kg at 18° C) and 487 lbs. at 120° F (221 kg at 49° C).

Obviously, when any additional force is applied after the beam like portions of the connecting tabs have fully bottomed against the adjacent edge, plastic deformation ceases and elastic deformation of the members is resumed. Any remaining force of the impact will increase the stress and tension on the crown straps, the remaining portions of the connecting tabs and the shell. Also, once any shock absorbing element of the suspension of the invention has been stressed beyond the elastic limit of the material of which it is made, it or the entire suspension can be readily and easily replaced by detaching the connecting tabs from the shell. Likewise, a damaged shell can be readily and easily replaced by detaching a perfectly good suspension therefrom and reattaching it to a new shell. However, it is advisable to replace the entire safety cap whenever the shell is damaged.

As many possible modifications and embodiments may be made of the invention, it is to be understood the invention is not limited to the specific embodiments disclosed hereinabove but includes all modifications and embodiments falling within the scope of the appended claims.

What is claimed is:

1. A safety cap with energy absorbing suspension comprising:

a relatively rigid shell having a generally convex exterior wall portion and adjoining concave internal cavity extending from a lower edge and adapted to extend around and receive an upper portion of a wearer's head, anchor means angularly spaced around adjacent the lower edge of the convex wall portion for attaching the suspension to the shell;

an energy absorbing suspension attached to the anchor means and having crown straps spaced from the shell and situated within the internal concave cavity between the anchor means for supporting engagement with the wearer's head, connecting means attached to and connecting the crown straps to the shell and each of the connecting means having an end portion attached to one of the anchor means, an elastically and plastically deformable energy absorbing portion attached to an end portion of a crown strap, and control means adjacent to and engageable by the energy absorbing portion for first allowing elastic deformation of, then controlling and limiting plastic deformation of the energy absorbing portion;

whereby energy of an impact against and displacing the shell is absorbed by first placing the crown straps engaging and resisted by the wearer's head in tension and pulled tightly against the energy absorbing portions to firmly seat the end portions of the connecting means against the anchor means after which the crown straps elastically and then plastically deform the energy absorbing portions into engagement with the adjacent control means.

2. A safety cap according to claim 1 wherein the energy absorbing portion of the connecting means comprises:

an elongated beam like portion of predetermined thickness, width and length situated in and integrally connected at opposite ends to an intermediate portion of the connecting means and having an edge of predetermined length adjoining a slot through which an end portion of a crown strap passes, loops around and engages the beam, and an opposite edge adjoining an aperture and of shorter length than the edge of the beam adjoining the slot.

3. A safety cap according to claim 2 wherein the control means comprises:

an arcuate shape aperture adjoining the opposite edge of the energy absorbing beam and into which the beam is bent and elongated during plastic deformation, and an arcuate edge extending between and from opposite ends of the beam to a center situated a predetermined maximum center distance from the opposite edge of the beam which during plastic deformation progressively engages and abutts against greater amounts of the arcuate edge from the ends toward the center to control and limit the extent of plastic deformation of the beam.

4. A safety cap according to claim 3 wherein each of the anchor means comprises:

a socket including a wedge shape socket cavity, into which a mating wedge shape end portion of the connecting means is inserted, retaining means adjacent the lower edge and entrance to the socket cavity for retaining the wedge shape end portion of the connecting means in the cavity, opposing spaced sidewalls extending from the retaining means toward a socket land, an outer wall extending between the spaced sidewalls, an inner slotted wall, including a slot through which the connecting means extend from the socket cavity, spaced from and inclined relative to the outer wall.

5. A safety cap according to claim 4 wherein the wedge shape end portion of the connecting means comprises:

a shoulder spaced from and for abutting engagement with the socket land.

6. A safety cap according to claim 5 further comprising:

a headband attached to and supported by the connecting means, and means for attaching the headband to the connecting means.

7. A safety cap according to claim 6 wherein the means for attaching the headband to the connecting means comprises:

an integral opposite end portion connected to, bent inwardly of and extending along side the intermediate portion of the connection means and having a bent portion joined to the intermediate portion and extending inwardly into the internal cavity, an aperture in the bent portion through which an end portion of a crown strap passes and loops around the energy absorbing beam, an end portion extending from the bent portion and attached to the headband; and fastening means for attaching the end portion to the headband.

8. A safety cap according to claim 6 wherein the means for attaching the headband to the connecting means comprises:

a headed fastener extending from the connecting means and through an aperture in the headband.

9. A safety cap according to claim 1 wherein the energy absorbing portion comprises:

an elongated primary beam of predetermined thickness, width and length situated in an intermediate portion of the connecting means, extending between and integrally connected at opposite ends to opposite side portions of the intermediate portion and having a lower edge, and an opposite edge adjoining a narrow elongated slot of predetermined width in the control means; and an elongated secondary beam of predetermined thickness, width and length situated adjacent and connected to the lower edge of the primary beam and engaged by an end portion of a crown strap which passes through an adjoining opening and loops around the secondary and primary beams;

whereby the energy of an impact against and displacing the shell causes the crown straps to deform and displace the secondary beams relative to primary beams, the secondary beams to absorb a portion of the energy and the secondary beams to deform and displace the primary beam into engagement with the adjacent control means.

10. A safety cap according to claim 9 further comprising:

support means extending between the beams for supporting and connecting the secondary beam to the primary beam, and transmitting the energy of the impact to the primary beam whereby the primary beam is deformed and displaced into the control means.

11. A safety cap according to claim 10 wherein the support means comprises:

a plurality of gussets spaced longitudinally between the beams.

12. An energy absorbing safety cap according to claim 11 wherein the secondary beam is no longer, of less width and thickness than the primary beam and situated adjacent a side of the intermediate portion nearest the shell.

13. A safety cap according to claim 12 wherein each of the anchor means comprises:

a socket including a wedge shape socket cavity, into which a mating wedge shape end portion of the connecting means is inserted;

retaining means adjacent the lower edge and entrance to the socket cavity for retaining the wedge shape end portion of the connecting means in the cavity;

opposing spaced sidewalls extending from the retaining means toward a socket land; an outer wall extending between the spaced sidewalls; and an inner slotted wall, including a slot through which the connecting means extend from the socket cavity, spaced from and inclined relative to the outer wall.

14. A safety cap according to claim 13 wherein the wedge shape end portion of the connecting means comprises:

a shoulder spaced from and for abutting engagement with the socket land.

15. A safety cap according to claim 14 further comprising:

a headband attached to and supported by the connecting means, and means for attaching the headband to the connecting means.

16. A safety cap according to claim 15 wherein the means for attaching the headband to the connecting means comprises:

a headed fastener extending from the connecting means and through an aperture in the headband.

17. A safety cap according to claim 10 wherein the control means comprises:

an elongated narrow slot of predetermined width in an upper portion of the connecting means adjoining the opposite edge of the primary beam and into which the primary beam is bent and displaced during plastic deformation; and an edge adjoining the narrow slot, extending between opposite side portions of the upper portion and situated a predetermined distance from the opposite edge of the beam which during plastic deformation engages and bottoms against the edge to control and limit the extent of plastic deformation of the primary beam.

18. A safety cap according to claim 17 wherein the elongated slot is narrower and of lesser predetermined width adjacent each of the opposite end portions of the primary beam than it is adjacent an intermediate portion of the primary beam whereby plastic deformation and displacement of the opposite end portions of the primary beam is controlled and limited by the narrower width and the intermediate portion by a greater width of the elongated slot.

19. A safety cap according to claim 17 wherein the control means further comprises:

protrusions projecting into and reducing the width of opposite end portions of the elongated slot adjacent the opposite end portions of the primary beam whereby plastic deformation and displacement of the end portions of the primary beam is controlled by the protrusions afterwhich plastic deformation and displacement of the primary beam into a wider intermediate portion of the elongated slot is controlled and limited by bottoming of the beam against the edge.

* * * * *